US006523366B1

(12) United States Patent
Bonaquist et al.

(10) Patent No.: US 6,523,366 B1
(45) Date of Patent: Feb. 25, 2003

(54) CRYOGENIC NEON REFRIGERATION SYSTEM

(75) Inventors: Dante Patrick Bonaquist, Grand Island, NY (US); Jalal Zia, Tonawanda, NY (US); Nancy Jean Lynch, North Tonawanda, NY (US); Michael John Stanko, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/022,335

(22) Filed: Dec. 20, 2001

(51) Int. Cl.[7] ..... F25J 1/00
(52) U.S. Cl. ..... 62/613
(58) Field of Search ..... 62/114, 467, 513, 62/910, 612, 613; 252/67

(56) References Cited

U.S. PATENT DOCUMENTS 4,291,547 A 9/1981 Leo ..... 62/402
4,982,889 A * 1/1991 Eardley ..... 277/27
5,045,711 A * 9/1991 Swearingen ..... 290/52
5,469,711 A 11/1995 McCoy ..... 62/51.1
5,799,505 A 9/1998 Bonaquist et al. ..... 62/613
5,836,173 A 11/1998 Lynch et al. ..... 62/613
6,041,620 A 3/2000 Olszewski et al. ..... 62/612
6,105,388 A * 8/2000 Acharya et al. ..... 62/612
6,250,096 B1 6/2001 Bonaquist et al. ..... 62/401
6,438,994 B1 * 8/2002 Rashad et al. ..... 62/613

* cited by examiner

*Primary Examiner*—William C. Doerrler
*Assistant Examiner*—Malik N. Drake
(74) *Attorney, Agent, or Firm*—Stanley Ktorides

(57) ABSTRACT

A system for generating low temperature refrigeration for use such as cooling superconducting cable wherein a neon based refrigerant fluid is work expanded by a sealed turboexpander/loader to generate refrigeration which is used to cool heat transfer fluid for provision to the use point.

23 Claims, 2 Drawing Sheets

CRYOGENIC NEON REFRIGERATION SYSTEM

TECHNICAL FIELD

This invention relates generally to the provision of refrigeration and is particularly advantageous for providing low temperature or cryogenic refrigeration using a neon-based working fluid to generate the refrigeration.

BACKGROUND ART

The use of low temperature or cryogenic refrigeration is becoming increasingly important in such applications as cooling power transmission cable for superconductivity purposes. Conventional methods for providing refrigeration are generally inadequate when the provision of low temperature refrigeration is desired. Typically, when the generation of low temperature refrigeration is desired, hydrogen or helium is used as the working fluid. These fluids are relatively inexpensive but, because of their low molecular weight, there is an increased difficulty of compressing these fluids. This problem is overcome by increasing the complexity and cost of the compressors used to power the cycle.

Neon has a relatively high molecular weight compared with other very low boiling components such as hydrogen or helium and thus may be more easily compressed for better operation of a refrigeration cycle. Unfortunately, neon is significantly more costly than either hydrogen or helium making its use problematic in a refrigeration cycle. A viable system which will enable the use of neon as the working fluid to generate refrigeration for low temperature refrigeration applications would be highly desirable.

Accordingly, it is an object of this invention to provide an improved system which uses a neon refrigerant fluid to generate refrigeration for use in low temperature, e.g. cryogenic, applications.

SUMMARY OF THE INVENTION

The above and other objects, which will become apparent to those skilled in the art upon a reading of this disclosure, are attained by the present invention, one aspect of which is:

A method for providing low temperature refrigeration to a use point comprising:

(A) compressing refrigerant fluid comprising neon to produce compressed neon refrigerant fluid, and passing the compressed neon refrigerant fluid to a sealed turboexpander/loader;

(B) expanding the compressed neon refrigerant fluid by passage through the turboexpander of the sealed turboexpander/loader to produce refrigeration bearing neon refrigerant fluid;

(C) warming the refrigeration bearing neon refrigerant fluid by indirect heat exchange with heat transfer fluid to produce cooled heat transfer fluid having low temperature refrigeration; and (D) passing the cooled heat transfer fluid to a use point and providing low temperature refrigeration to the use point.

Another aspect of the invention is:

Apparatus for providing low temperature refrigeration to a use point comprising:

(A) a compressor and means for providing refrigerant fluid comprising neon to the compressor;

(B) a sealed turboexpander/loader and means for passing neon refrigerant fluid from the compressor to the turboexpander of the sealed turboexpander/loader;

(C) a heat exchanger, means for passing neon refrigerant fluid from the turboexpander of the sealed turboexpander/loader to the heat exchanger, and means for passing heat transfer fluid to the heat exchanger; and (D) a use point, and means for passing heat transfer fluid from the heat exchanger to the use point.

A further aspect of the invention is:

A sealed turboexpander/loader comprising a turboexpander and a loader coupled together by a shaft, a seal encapsulating the turboexpander, loader and shaft, input means for passing refrigerant fluid to the turboexpander, said input means passing through the seal, and output means for passing refrigerant fluid from the turboexpander, said output means passing through the seal.

As used herein the term "turboexpander" means a device for the flow of high pressure gas through a turbine to reduce the pressure and the temperature of the gas thereby generating refrigeration.

As used herein the term "loader" means a device which receives energy from a turboexpander.

As used herein the term "turboexpander/loader" means a device comprising a turboexpander and loader wherein energy is passed by means of a shaft from the turboexpander to the loader.

As used herein the term "seal" means an essentially air tight structure.

As used herein the term "indirect heat exchange" means the bringing of two fluids into heat exchange relation without any physical contact or intermixing of the fluids with each other.

As used herein the term "subcooling" means cooling a liquid to be at a temperature lower than the saturation temperature of that liquid for the existing pressure.

As used herein the term "cold box" means an enclosure for cryogenic process equipment used to protect from excessive heat leak.

As used herein the term "buffer vessel" means a vessel used to store a process fluid temporarily dispersing it when needed by the process and storing it when it is not required by the process.

Figure 1:
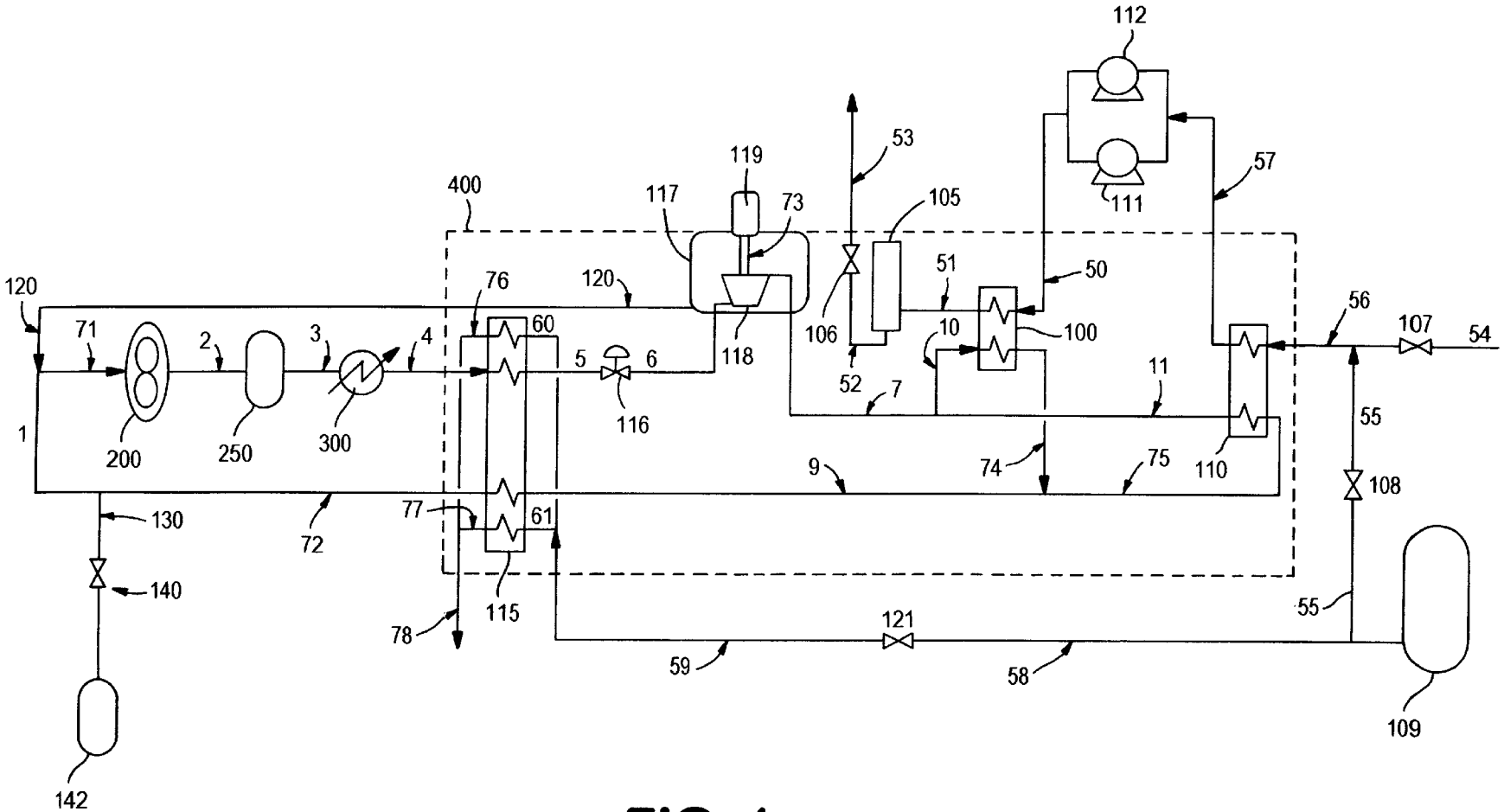
FIG. 1 is a schematic representation of one preferred embodiment of the refrigeration system of this invention.

The numerals in the Drawings are the same for the common elements.

DETAILED DESCRIPTION

Figure 2:
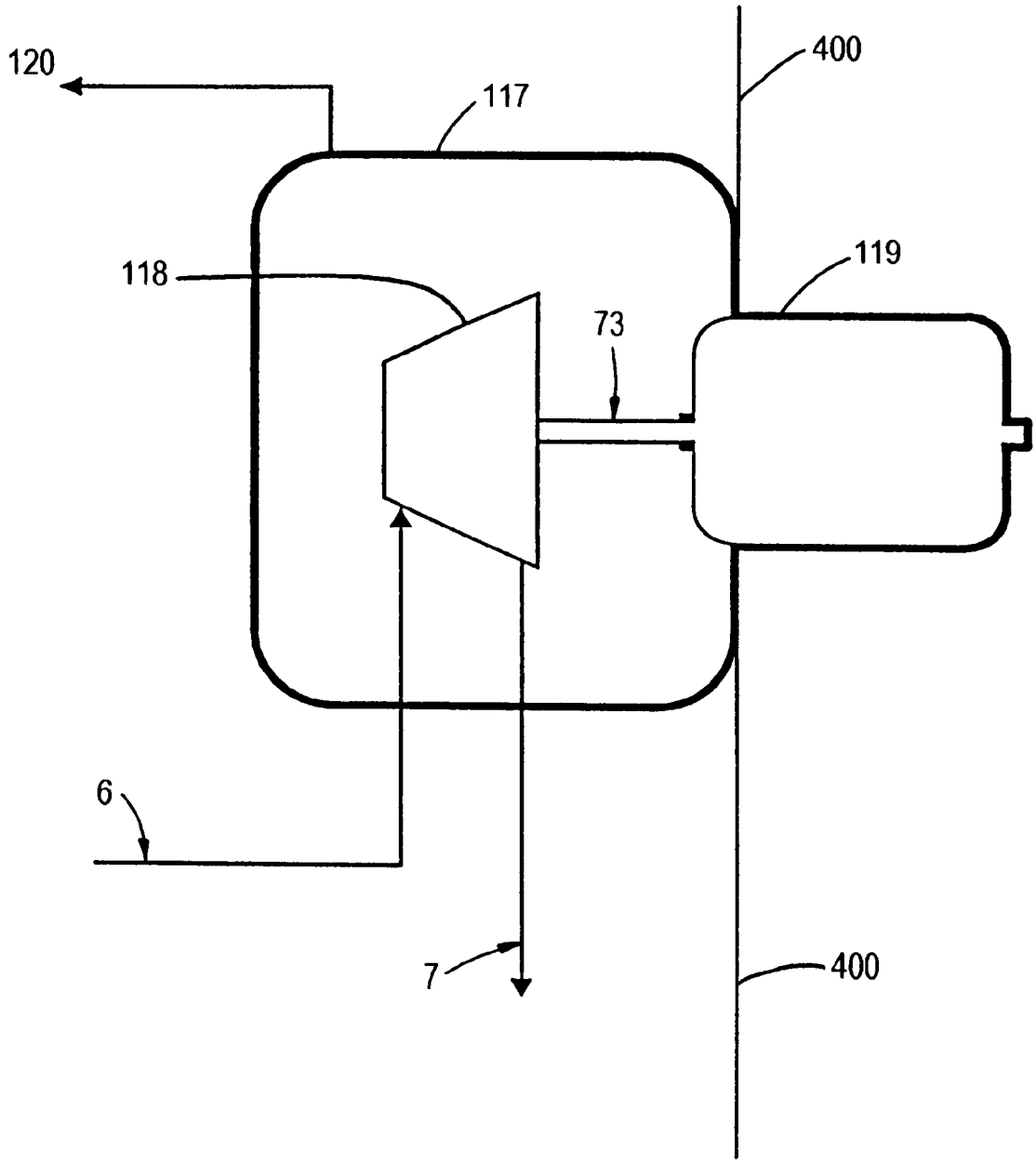
FIG. 2 is a simplified representation of one preferred embodiment of the sealed turboexpander/loader of this invention.

The invention will be described in detail with reference to the Drawings. Referring now to FIGS. 1 and 2, refrigerant fluid 71 is passed to a compressor, such as oil flooded screw compressor 200, wherein it is compressed to a pressure generally within the range of from 170 to 270 pounds per square inch absolute (psia). The refrigerant fluid comprises neon, either solely or in a mixture with one or more other components such as hydrogen or helium. Preferably the refrigerant fluid comprises 100 percent neon. When the refrigerant fluid is a mixture, the neon is present in the mixture in a concentration generally of at least 50 mole percent.

In the embodiment of the invention illustrated in FIG. 1, the neon refrigerant fluid 71 is made up from recycled refrigerant 72 which is combined with make-up refrigerant fluid 130 from tank 142 through valve 140 to form stream 1, and from leakage recovery stream 120.

Compressed neon refrigerant fluid 2 from compressor 200 passes through a series of coalescing filters 250 to remove oil from the compressed neon refrigerant fluid so that the oil concentration in resulting compressed neon refrigerant fluid 3 is 10 parts per billion or less. The oil circulation system also serves to remove most of the heat of compression produced in compressor 200. Compressed neon refrigerant fluid 3 is then cooled in aftercooler 300 to remove the heat of compression not removed by the oil separation and filtration system 250. Resulting neon refrigerant fluid 4 at about ambient temperature is passed into a cold box 400 whose shell is shown by the dotted line in FIG. 1.

Neon refrigerant fluid 4 is cooled by passage through heat exchanger 115 to a temperature preferably within the range of from 87 to 89K by indirect heat exchange with streams as will be more fully described below. Resulting cooled compressed neon refrigerant fluid in stream 5 is passed through valve 116 and as stream 6 is passed through seal 117 as input to turboexpander 118.

The sealed turboexpander/loader comprises turboexpander 118, generator 119 and shaft 73 encapsulated by seal 117 so that essentially no gas leakage to the atmosphere occurs across seal 117. Seal 117 is typically made of stainless steel. Other loaders which may be used in the practice of this invention in place of the generator shown in FIGS. 1 and 2 include blowers and compressors. While the turboexpander is entirely within cold box 400, the loader is only partly within the cold box and is partly outside the cold box. Preferably only the portion of the loader which receives shaft 73 is within cold box 400. One of the advantages of the invention is that no shaft seals are necessary on shaft 73 although shaft seals may be used if desired. The outboard bearing of the loading generator 119 is completely sealed so that no leakage to the atmosphere can occur at that point. No attempt is made to prevent the intrusion of neon into the cavity of the generator through the bell housing on the shaft end of the generator 119. What small amount of leakage of neon that does occur through the shaft seals of the turbine 118 is captured in the hermetically sealed housing 117 and can be returned to the suction of the refrigerant compressor by line 120 thus ensuring a no-loss system. All piping and electrical connections through seal 117 are positively sealed.

Cooled compressed neon refrigerant fluid passed to turboexpander 118 in input line or stream 6 is turboexpanded within turboexpander 118 to produce refrigeration bearing neon refrigerant fluid which is passed out from turboexpander 118 in output line or stream 7 and out of the sealed turboexpander/loader. The refrigeration bearing neon refrigerant in stream 7 will generally be at a pressure within the range of from 55 to 95 psia and preferably at a temperature of about 64 to 65K. The refrigeration bearing neon refrigerant fluid is then passed to a heat exchanger wherein it is warmed to provide low temperature refrigeration to heat transfer fluid.

In the embodiment of the invention illustrated in FIG. 1, refrigeration bearing neon refrigerant fluid is divided into a first portion 10 and a second portion 11, both of which are passed to heat exchangers to provide low temperature refrigeration to heat transfer fluid. Stream 10 is passed to subcooler 100 emerging therefrom as stream 74, and stream 11 is passed to heat exchanger 110, emerging therefrom as stream 75. Streams 74 and 75 are combined to form stream 9 which is warmed by passage through heat exchanger 115 serving to provide cooling to refrigerant fluid 4. The warmed refrigerant fluid is passed out of heat exchanger 115 in stream 72 which is passed out of cold box 400 and is recycled as was previously described to compressor 200 and the refrigeration cycle begins anew.

A preferred use point or application in the practice of this invention is superconducting cable, and a preferred heat transfer fluid in the practice of this invention is liquid nitrogen. The preferred application and heat transfer fluid are shown in the system illustrated in FIG. 1. Other heat transfer fluids which may be used in the practice of this invention include gaseous helium, liquid argon and gaseous neon. Among the other applications for the refrigeration provided by this invention one can name superconducting transformers, fault current limiters, superconducting generators, and superconducting motors.

Referring back now to FIG. 1, liquid nitrogen 54 being returned from use to cool superconducting cable is passed through valve 107 and combined with makeup liquid nitrogen in stream 55 from liquid nitrogen tank 109 through valve 108 to form liquid nitrogen heat transfer fluid 56 which is passed into cold box 400. Liquid nitrogen heat transfer fluid 56 is passed to heat exchanger 110 wherein it is cooled by indirect heat exchange with neon refrigerant fluid 11 to ensure sufficient net positive suction head at the inlet of duplicate pumps 111 and 112. Two pumps are provided to ensure fail-safe operation. The pressure of cooled liquid nitrogen stream 57 is increased to within the range of from 87 to 240 psia by pump 111 or 112. Pump effluent 50 is directed to subcooler 100 which is designed with sufficient surface area to ensure that liquid nitrogen stream 50 entering, for example, at 85 K will be cooled down to at least 67 K. After exiting subcooler 100, subcooled liquid nitrogen 51 flows to buffer vessel 105. Buffer vessel 105 is partially filled with subcooled liquid nitrogen. The headspace of buffer vessel 105 is pressurized by helium gas. The flow rate of subcooled liquid nitrogen 52 leaving buffer tank 105 is regulated by valve 106. After passing through valve 106, subcooled liquid nitrogen 53 is supplied to a superconducting cable system.

In the preferred embodiment of the invention illustrated in FIG. 1, liquid nitrogen is also employed to assist in the initial cooling of the neon refrigerant fluid. Liquid nitrogen in stream 58 is passed through valve 121 and resulting stream 59 is divided into streams 60 and 61 both of which are passed into heat exchanger 115 wherein they are warmed and preferably at least partially, most preferably completely vaporized, to provide cooling by indirect heat exchange to neon refrigerant fluid 4. Streams 60 and 61 emerge from heat exchanger 115 as streams 76 and 77 respectively which are combined to form stream 78 for passage out of the system.

Although the invention has been described in detail with reference to a certain preferred embodiment, those skilled in the art will recognize that there are other embodiments of the invention within the spirit and the scope of the claims. For example, preferably the generator-loaded turbine is fitted with magnetic bearings. Magnetic bearings eliminate the need to lubricate the turbine shaft with oil or a process gas. The generator can be designed to sink against a variable resistor array; however, allowing the generator to supplement the compressor power draw may enhance system efficiency. The hermetically sealed generator may be supplied with an external cooling coil. Alternatively, the turbine 118 may be compressor/blower-loaded with the turbine 118 and compressor/blower using gas or magnetic bearings. In the case of gas bearings, it will be necessary to provide a supply of neon working fluid to the gas bearings at a suitable pressure. Since the neon used in the gas bearing will necessarily escape into the enclosure surrounding the turbine, it will also be necessary to provide a means 120 to allow the escaping gas to return to the low-pressure side of compressor 200. Although the invention has been described with the use of neon as a working fluid operating, for example, in the vicinity of 85 to 65 K, the invention may be used with other working fluids at any temperature practical for Reverse-Brayton cycles to operate. In general, the invention may be used to provide refrigeration under any circumstances where it is desired to avoid loss of the working fluid charge. Including neon, suitable working fluids are hydrogen, helium, nitrogen, argon, oxygen methane, krypton, xenon, R-14, R-23, R-218 and mixtures employing one or more components listed here. A centrifugal or other type of compressor equipped with the proper seal leakage recovery system may be used as an alternative to the oil flooded screw compressor.

What is claimed is:

1. A method for providing low temperature refrigeration to a use point comprising:

(A) compressing refrigerant fluid comprising neon to produce compressed neon refrigerant fluid, and passing the compressed neon refrigerant fluid to a sealed turboexpander/loader;

(B) expanding the compressed neon refrigerant fluid by passage through the turboexpander of the sealed turboexpander/loader to produce refrigeration bearing neon refrigerant fluid;

(C) warming the refrigeration bearing neon refrigerant fluid by indirect heat exchange with heat transfer fluid to produce cooled heat transfer fluid having low temperature refrigeration wherein the heat transfer fluid is increased in pressure prior to the heat exchange with the refrigeration bearing neon refrigerant fluid; and (D) passing the cooled heat transfer fluid to a use point and providing low temperature refrigeration to the use point.

2. The method of claim 1 wherein the heat transfer fluid is subcooled in the heat exchange with the refrigeration bearing neon refrigerant fluid.

3. The method of claim 1 wherein the heat transfer fluid comprises liquid nitrogen.

4. The method of claim 1 wherein the use point comprises superconducting cable.

5. Apparatus for providing low temperature refrigeration to a use point comprising:

(A) a compressor and means for providing refrigerant fluid comprising neon to the compressor;

(B) a sealed turboexpander/loader and means for passing neon refrigerant fluid from the compressor to the turboexpander of the sealed turboexpander/loader;

(C) a heat exchanger, means for passing neon refrigerant fluid from the turboexpander of the sealed turboexpander/loader to the heat exchanger, and means for passing heat transfer fluid to the heat exchanger;

(D) a use point, and means for passing heat transfer fluid from the heat exchanger to the use point; and (E) a second heat exchanger and means for passing neon refrigerant fluid from the turboexpander of the sealed turboexpander/loader to the second heat exchanger, and wherein the means for passing heat transfer fluid to the heat exchanger includes the second heat exchanger.

6. The apparatus of claim 5 wherein the loader of the sealed turboexpander/loader is a generator.

7. The apparatus of claim 5 wherein the means for passing heat transfer fluid to the heat exchanger includes a liquid pump downstream of the second heat exchanger.

8. The apparatus of claim 5 further comprising a cold box wherein the turboexpander of the sealed turboexpander/loader is completely within the cold box and the loader of the sealed turboexpander/loader is not completely within the cold box.

9. The apparatus of claim 5 wherein the means for passing heat transfer fluid from the heat exchanger to the use point includes a buffer vessel.

10. The apparatus of claim 5 wherein the use point comprises superconducting cable.

11. A sealed turboexpander/loader comprising a turboexpander and a loader coupled together by a shaft, a seal encapsulating the turboexpander, loader and shaft, input means for passing refrigerant fluid to the turboexpander, said input means passing through the seal, and output means for passing refrigerant fluid from the turboexpander, said output means passing through the seal.

12. The sealed turboexpander/loader of claim 11 wherein the loader is a generator.

13. The sealed turboexpander/loader of claim 11 further comprising leakage recovery means for passing gas out from the sealed turboexpander/loader.

14. A method for providing low temperature refrigeration to a use point comprising:

(A) compressing refrigerant fluid comprising neon to produce compressed neon refrigerant fluid, and passing the compressed neon refrigerant fluid to a sealed turboexpander/loader;

(B) expanding the compressed neon refrigerant fluid by passage through the turboexpander of the sealed turboexpander/loader to produce refrigeration bearing neon refrigerant fluid;

(C) warming the refrigeration bearing neon refrigerant fluid by indirect heat exchange with heat transfer fluid to produce cooled heat transfer fluid having low temperature refrigeration wherein the heat transfer fluid is subcooled in the heat exchange with the refrigeration bearing neon refrigerant fluid; and (D) passing the cooled heat transfer fluid to a use point and providing low temperature refrigeration to the use point.

15. The method of claim 14 wherein the heat transfer fluid comprises liquid nitrogen.

16. The method of claim 14 wherein the use point comprises superconducting cable.

17. A method for providing low temperature refrigeration to a use point comprising:

(A) compressing refrigerant fluid comprising neon to produce compressed neon refrigerant fluid, and passing the compressed neon refrigerant fluid to a sealed turboexpander/loader comprising a turboexpander and a loader coupled together by a shaft, a seal encapsulating the turboexpander, loader and shaft, input means for passing refrigerant fluid to the turboexpander, said input means passing through the seal, and output means for passing refrigerant fluid from the turboexpander, said output means passing through the seal;

(B) expanding the compressed neon refrigerant fluid by passage through the turboexpander of the sealed turboexpander/loader to produce refrigeration bearing neon refrigerant fluid;

(C) warming the refrigeration bearing neon refrigerant fluid by indirect heat exchange with heat transfer fluid to produce cooled heat transfer fluid having low temperature refrigeration; and (D) passing the cooled heat transfer fluid to a use point and providing low temperature refrigeration to the use point.

18. The method of claim 17 wherein the heat transfer fluid comprises liquid nitrogen.

19. The method of claim 17 wherein the use point comprises superconducting cable.

20. Apparatus for providing low temperature refrigeration to a use point comprising:

(A) a compressor and means for providing refrigerant fluid comprising neon to the compressor;

(B) a sealed turboexpander/loader and means for passing neon refrigerant fluid from the compressor to the turboexpander of the sealed turboexpander/loader;

(C) a heat exchanger, means for passing neon refrigerant fluid from the turboexpander of the sealed turboexpander/loader to the heat exchanger, and means for passing heat transfer fluid to the heat exchanger;

(D) a use point, and means for passing heat transfer fluid from the heat exchanger to the use point; and (E) a cold box wherein the turboexpander of the sealed turboexpander/loader is completely within the cold box and the loader of the sealed turboexpander/loader is not completely within the cold box.

21. The apparatus of claim 20 wherein the use point comprises superconducting cable.

22. Apparatus for providing low temperature refrigeration to a use point comprising:

(A) a compressor and means for providing refrigerant fluid comprising neon to the compressor;

(B) a sealed turboexpander/loader and means for passing neon refrigerant fluid from the compressor to the turboexpander of the sealed turboexpander/loader;

(C) a heat exchanger, means for passing neon refrigerant fluid from the turboexpander of the sealed turboexpander/loader to the heat exchanger, and means for passing heat transfer fluid to the heat exchanger;

(D) a use point, and means for passing heat transfer fluid from the heat exchanger to the use point wherein the means for passing heat transfer fluid from the heat exchanger to the use point includes a buffer vessel.

23. The apparatus of claim 22 wherein the use point comprises superconducting cable.

* * * * *